US007080924B2

(12) United States Patent
Tseng et al.

(10) Patent No.: US 7,080,924 B2
(45) Date of Patent: Jul. 25, 2006

(54) LED LIGHT SOURCE WITH REFLECTING SIDE WALL

(75) Inventors: Tzyy Jang Tseng, Hsinchu (TW); Bily Wang, Hsin-Chu (TW); Alen Ke, Tainan (TW)

(73) Assignee: Harvatek Corporation, Hsin-Chu (TW)

( * ) Notice: Subject to any disclaimer, the term of this patent is extended or adjusted under 35 U.S.C. 154(b) by 147 days.

(21) Appl. No.: 10/307,546

(22) Filed: Dec. 2, 2002

(65) Prior Publication Data

US 2004/0105262 A1 Jun. 3, 2004

(51) Int. Cl.
*F21V 11/00* (2006.01)

(52) U.S. Cl. ..... 362/241; 362/240; 362/247; 362/545; 362/800

(58) Field of Classification Search ..... 362/240, 362/241, 247, 231, 297, 545, 800, 346, 518
See application file for complete search history.

(56) References Cited

U.S. PATENT DOCUMENTS 5,384,693 A * 1/1995 Schwaller et al. ..... 362/800
5,642,933 A * 7/1997 Hitora ..... 362/297

* cited by examiner

*Primary Examiner*—Stephen F Husar
(74) *Attorney, Agent, or Firm*—Rosenberg, Klein & Lee

(57) ABSTRACT

A light emitting diode chip or chips array mounted on a substrate is surrounded by one or more side walls. The wall has an uneven reflecting surface to diverge the light emitted from the LED chip or chip array. The wall may have a triangular cross-section so that the emitted light diverges in all directions. When three double-sided reflecting walls surround three LED panels, the reflected light becomes omnidirectional hemispherically and can be used in a light bulb.

9 Claims, 6 Drawing Sheets

LED LIGHT SOURCE WITH REFLECTING SIDE WALL

BACKGROUND OF THE INVENTION (1) Field of the Invention

The invention relates to light emitting diodes (LED), in particular to LED panel as a light source.

(2) Brief Description of Related Art

FIG. 1 shows an LED chip or chips array 10 mounted on a substrate 12 to form an LED light source. The light rays A1, A2 emitted from the LED panel typically subtends a narrow angle nearly normal to the LED panel. Such a light source does not illuminate the areas outside the subtended angle, i.e. the light source is not omnidirectional. In most applications, it is desirable for the light source to be omnidiectional, so it can illuminate a bigger area.

SUMMARY OF THE INVENTION

An object of this invention is to broaden the area of illumination from a light emitting LED panel as a light source. Another object of this invention is to provide an omnidirectional light source. Still another of this invention is to provide a LED light bulb. Still another of this invention is to diffuse the light from a LED light bulb.

These objects are achieved by erecting an uneven side-walls beside the LED panel. These side-walls reflect the light from the LED panel in different directions so that the illumination covers a larger area. The side-walls have uneven surface e.g. saw-tooth contours to produce reflection light beams from the LED panel. The cross-sections of the uneven side-walls can be triangular or trapezoid or wave shape to reflect omnidirectional illumination. The LED light source can be mounted inside a light bulb to replace a conventional light bulb. Different color glass can be used for the light bulb to produce different color lights. The light bulb can be frosted to soften the emitted light.

DETAILED DESCRIPTION OF THE INVENTION

Figure 1:
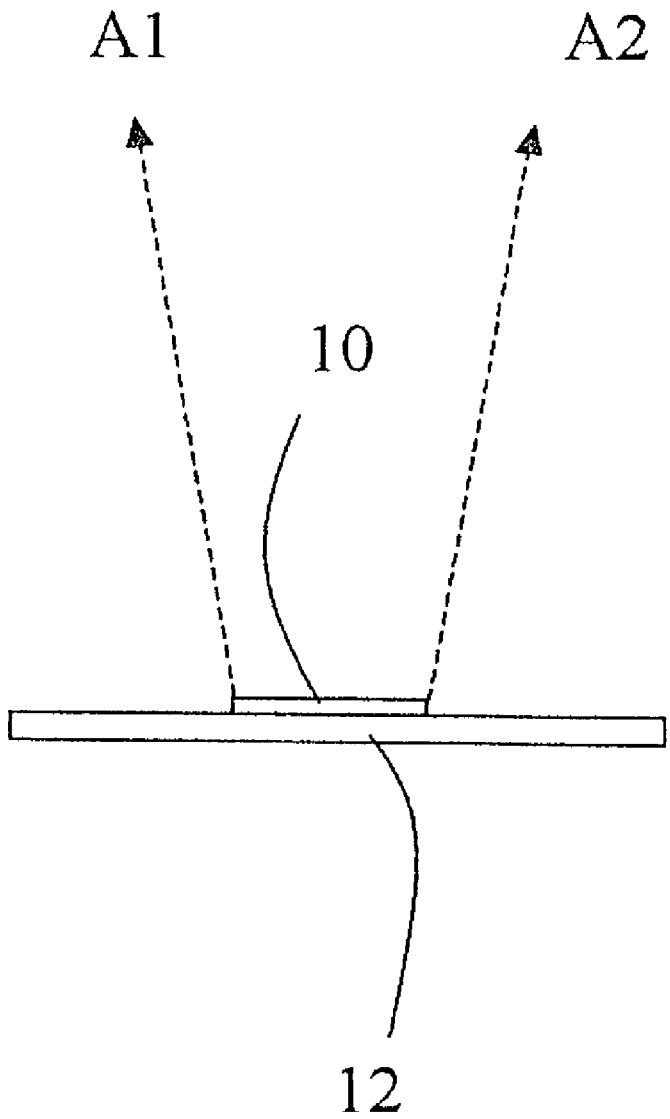
Fig.1 Prior Art
FIG. 1 shows a prior art LED panel as a light source.
Figure 2:
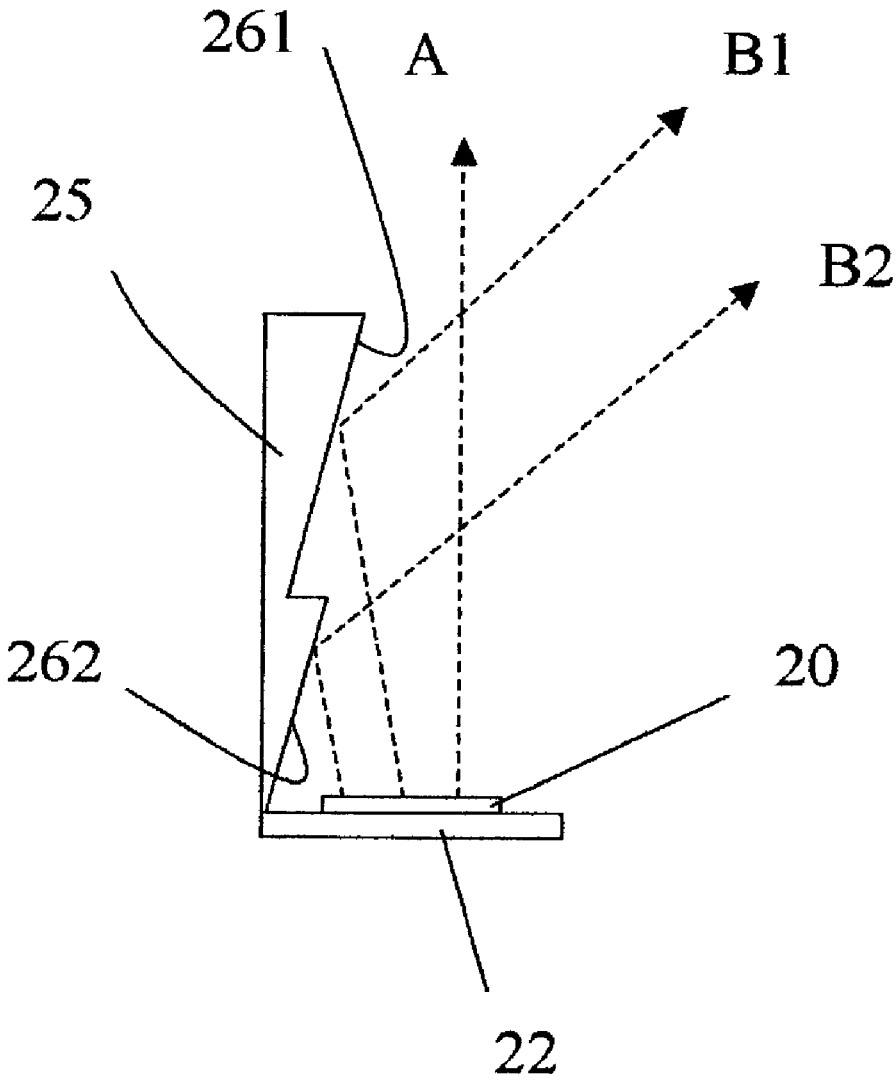
FIG. 2 shows the basic structure of the present invention having an uneven side-wall to reflect the light from the LED panel in an angle other than the normal direction of the LED panel.

FIG. 2 shows the basic structure of the present invention. A light emitting diode chip or chip array 20 is mounted on a substrate 22 to form an LED light source panel. A saw-tooth shaped side-wall 25 is erected vertically at the edge of the substrate 22. The LED panel 20 emits light beam A normally from points away from the side-wall 25. From different points on the LED panel 20, the light is reflected from the surface 261 and 262 of the saw-tooth side-wall as light beams B1, B2 at an angle divergent from the light beam A. Thus the light beams emitted from the LED panel 20 are spread out to cover more area than that from the prior art LED panel shown in FIG. 1.

Figure 3:
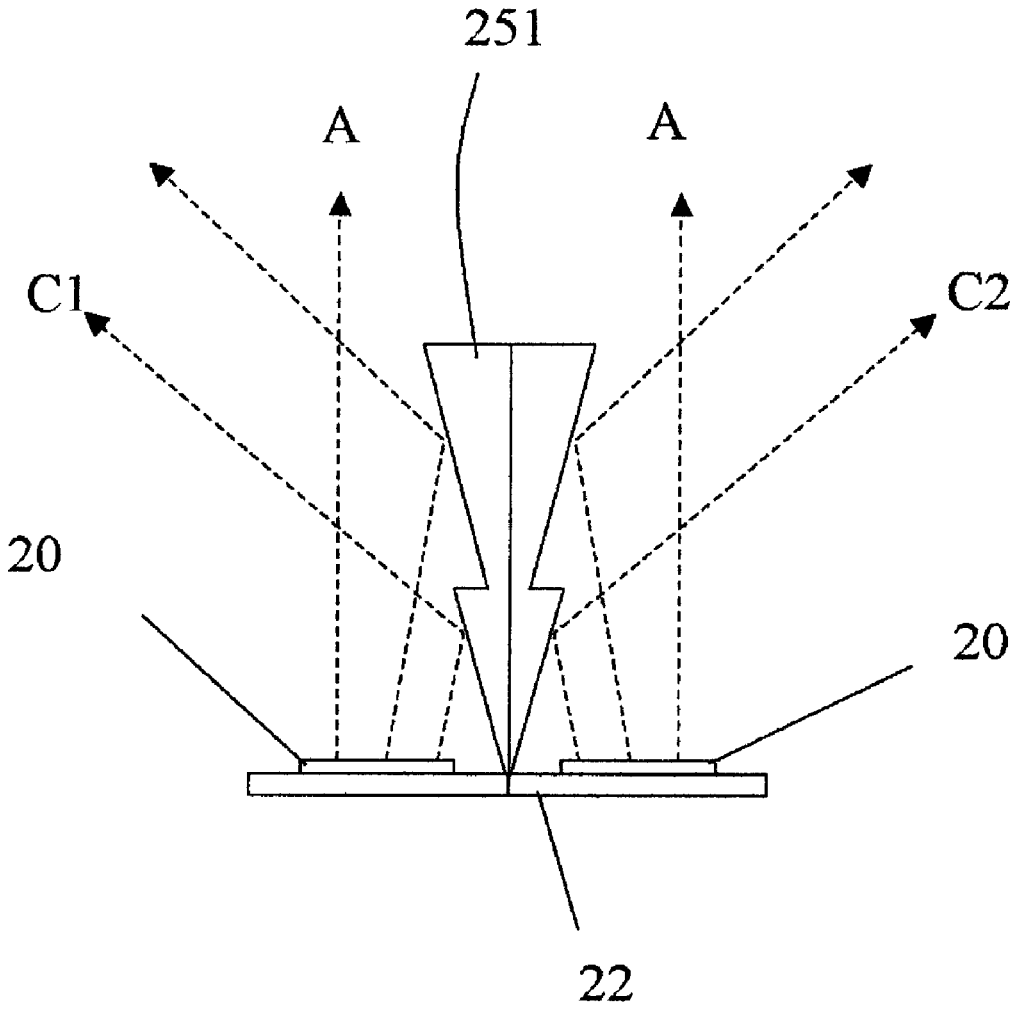
FIG. 3 shows a double-sided reflecting walls for two LED light panels.

FIG. 3 shows a second embodiment of the present invention. Two walled LED panels 20 and the substrate 22 similar to that shown in FIG. 2 are placed side by side. The reflecting walls 251 are butted against each other as a double-sided reflecting wall. Besides the normal light beams A from the two LED panels, the left-hand side-walls reflect the light from the left LED panel as light beams C1 toward the left-hand side, and the right-hand side walls reflect the light from the right LED panel as light beams C2. Thus, the light beams from the LED panels become divergent.

Figure 4:
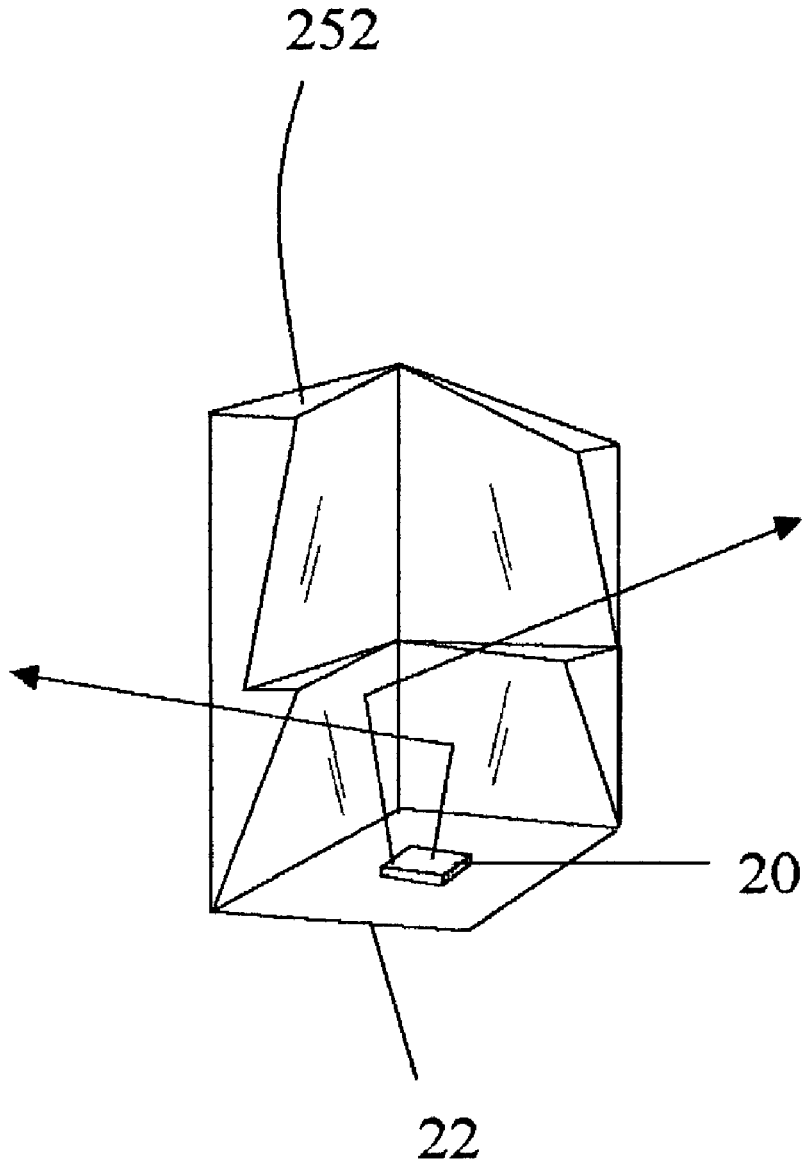
FIG. 4 shows two reflecting walls to provide wider angle illumination.

FIG. 4 shows a third embodiment of the present invention. A LED 20 is mounted on a substrate 22. Two saw-tooth reflecting side-walls 252 are erected vertically at two edges of the substrate 22. The two reflecting side-walls are placed at an angle less than 180 degrees. The saw-tooth side-walls have triangular cross-sections horizontally. Thus, the reflecting wall surfaces reflect the light beams from the LED panel 20 in different directions, illuminating an upper hemisphere.

Figure 5:
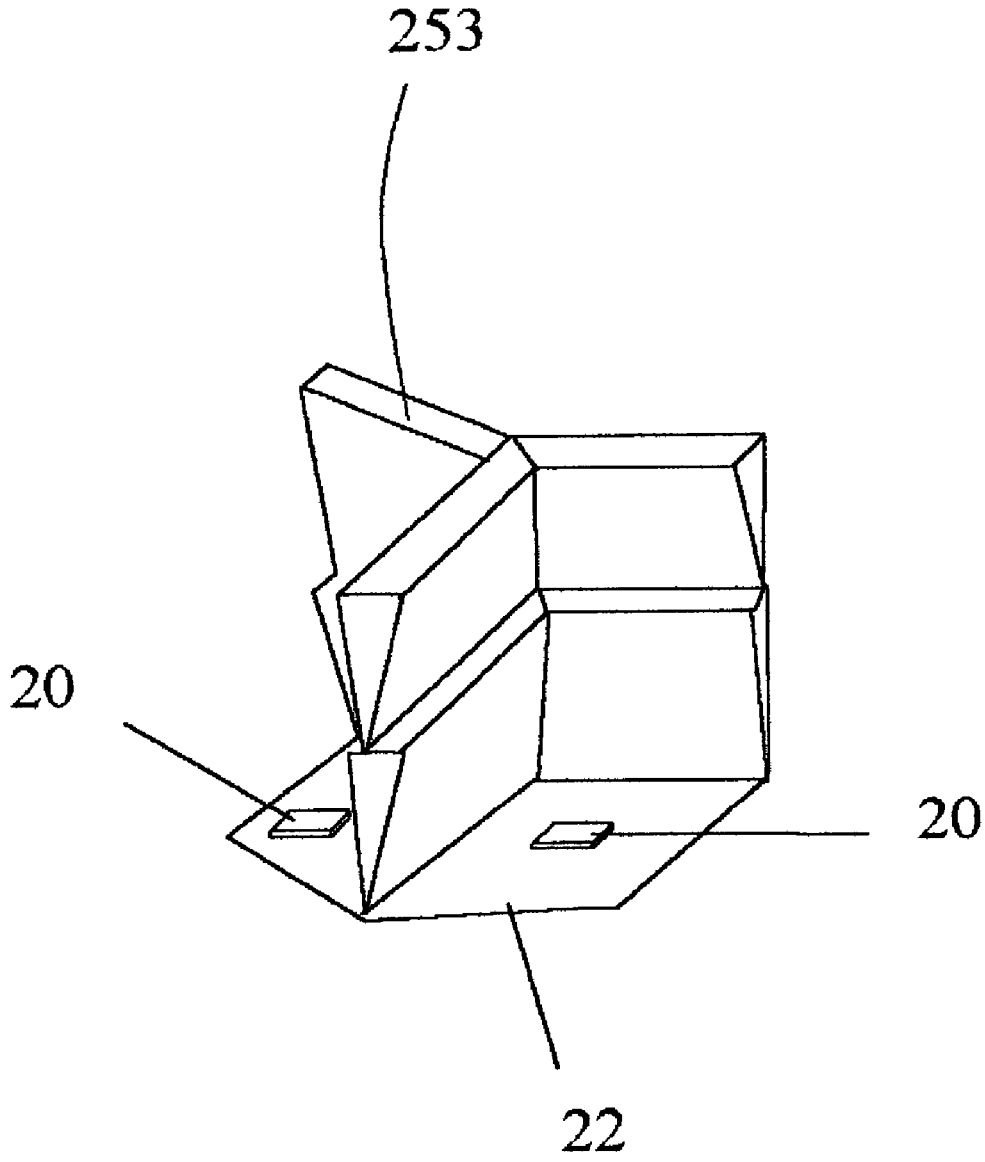
FIG. 5 shows a three reflecting walls to provide omnidirectional hemispheric illumination.

FIG. 5 shows a fourth embodiment of the present invention. Three saw-tooth reflecting side-walls 253 are erected vertically in three horizontal directions. Each wall is double-sided with triangular cross-sections similar to that in FIG. 4. One or more LED panels 20 are placed on the substrate between adjacent walls. When three LED panels 20 are used, the light source becomes omnidirectional to illuminate a hemisphere.

Figure 6:
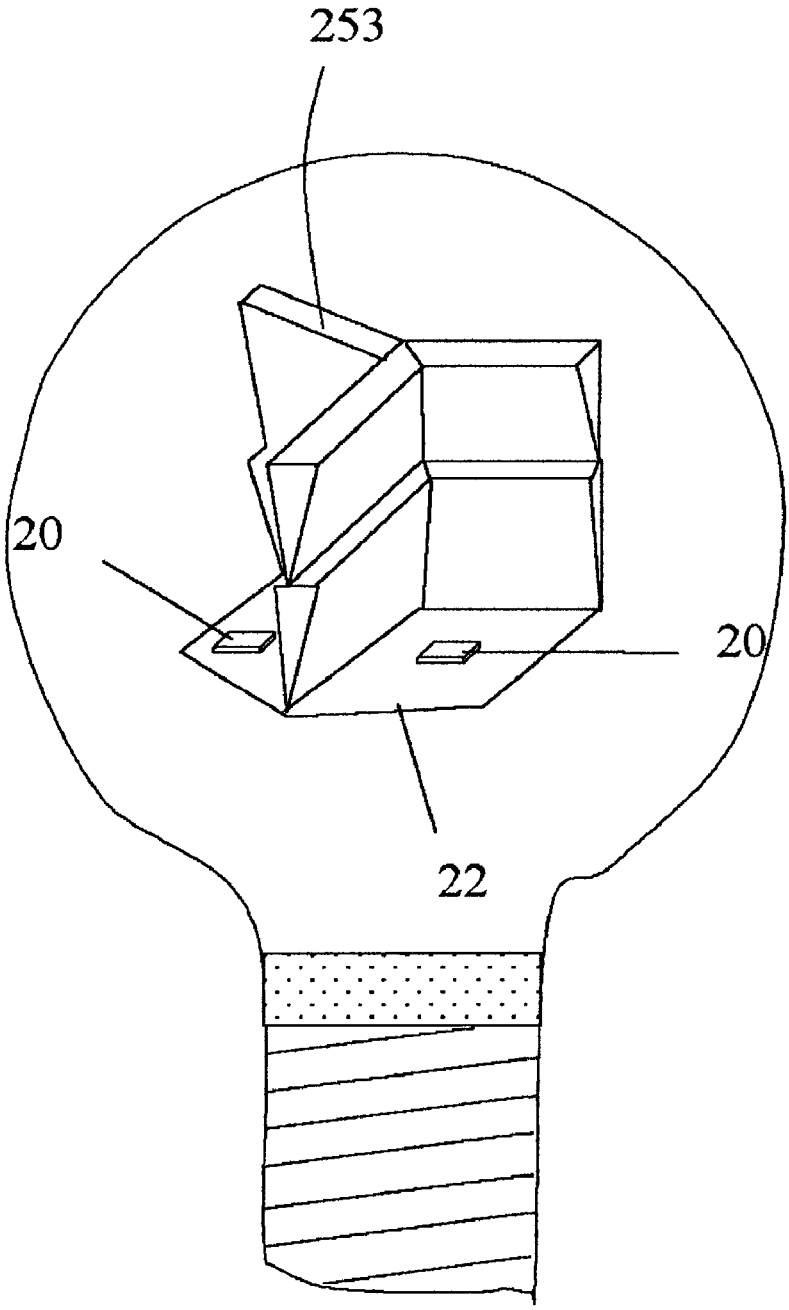
FIG. 6 shows the mounting of the 3-wall LED panels in a light bulb as a conventional light bulb.

FIG. 6 shows a fifth embodiment of the present invention. The three-wall light source is placed inside a light bulb to substitute as a conventional incandescent light bulb. The glass bulb can be of different colors to emit light of different colors. The glass bulb can also be ground to be frosted, thereby diffusing the emitted light. If ac power is used to energize the light source, a rectifier (not shown) may be used to convert the ac power into dc for the LED.

While the preferred embodiments of the invention have been described, it will be apparent to those skilled in art that various modifications may be made in the embodiments without departing from the spirit of the present invention. Such modifications are all within the scope of this invention.

The invention claimed is:

1. A light emitting diode (LED) light source, comprising:

at least one LED chip;

a substrate for mounting said chip; and at least a pair of transversely directed reflecting walls erected at said substrate to extend about said LED chip, said reflecting walls each having uneven contour, so that the light emitted by said LED chip is reflected simultaneously thereby in directions other than the normal direction of the LED chip;

wherein at least one said wall is double-sided to reflect the light emitted from two of said LED chip in opposite directions.

2. The LED light source as described in claim 1, wherein two of said reflecting walls are placed at an angle, each reflecting wall having a special cross-section so that the light reflected from the LED chip covers wider directions.

3. The LED light source as described in claim 2, wherein said special cross-section is selected from the group consisting of triangular cross-section, trapezoidal cross-section and wavy cross-section.

4. A light emitting diode (LED) light source, comprising:

at least one LED chip;

a substrate for mounting said chip;

at least a reflecting wall erected at an edge of said substrate and having uneven contour, so that the light emitted by LED is reflected in directions other than the normal direction of the LED chip;

wherein said wall is double-sided to reflect the light emitted from two of said LED chip in opposite directions; and, three said double-sided reflecting walls are placed at equal angles with respect with each other, and said LED is placed between two adjacent said walls.

5. The LED light source as described in claim 4, further comprising a glass bulb enclosure.

6. The LED light source as described in claim 5, wherein said glass bulb is frosted to diffuse the light emitted from said LED.

7. The LED light source as described in claim 5, wherein said light bulb is colored to radiate a color light.

8. The LED light source as described in claim 5, wherein said LED light source is energized responsive to rectified dc power.

9. A light emitting diode (LED) light source, comprising:

at least one LED chip;

a substrate for mounting said chip; and at least three transversely directed reflecting walls erected at said substrate to extend about said LED chip, said reflecting walls each having uneven contour, so that the light emitted by said LED chip is reflected simultaneously thereby in directions other than the normal direction of the LED chip;

wherein said three transversely directed reflecting walls are disposed at substantially equal angles each with respect to the other, three of said LED chip being disposed between adjacent ones of said walls.

* * * * *